United States Patent [19]

Kahn

[11] Patent Number: 4,569,073

[45] Date of Patent: Feb. 4, 1986

[54] ASYMMETRICAL SIDEBAND TRANSMISSION

[76] Inventor: Leonard R. Kahn, 137 E. 36 St. (Apt. 6A), New York, N.Y. 10016

[21] Appl. No.: 589,732

[22] Filed: Mar. 15, 1984

[51] Int. Cl.[4] ..... H04H 5/00

[52] U.S. Cl. ..... 381/16; 455/61; 455/102; 455/103

[58] Field of Search ..... 455/61, 102, 103, 108; 381/16, 15

[56] References Cited

U.S. PATENT DOCUMENTS

| | | | |
|---|---|---|---|
| 2,666,133 | 1/1954 | Kahn | 250/17 |
| 3,760,419 | 9/1973 | Poschadel et al. | 455/103 |
| 3,803,490 | 4/1974 | Almering et al. | 381/16 |
| 3,908,090 | 9/1975 | Kahn | 325/59 X |
| 4,124,779 | 11/1978 | Berens et al. | 381/16 |
| 4,185,171 | 1/1980 | Parker | 381/16 |
| 4,194,154 | 3/1980 | Kahn | 455/114 |
| 4,225,751 | 9/1980 | Hershberger | 381/16 |
| 4,338,491 | 7/1982 | Parker et al. | 381/16 |
| 4,373,115 | 2/1983 | Kahn | 332/37 D |

OTHER PUBLICATIONS

L. R. Kahn, "Compatible Single-Sideband," Proc. IRE, vol. 49, pp. 1503-1527, Oct. 1961.

*Primary Examiner*—Forester W. Isen

[57] ABSTRACT

An amplitude modulated radio transmission system is described which is compatible with conventional AM receivers. The transmitted signal comprises a carrier and two unequal amplitude sidebands. This signal can be received by receivers that are tuned to the carrier as well as receivers that are off tuned to favor the stronger sideband.

6 Claims, 7 Drawing Figures

ASYMMETRICAL SIDEBAND TRANSMISSION

BACKGROUND OF THE INVENTION

While the invention is subject to a wide range of applications, it is especially suited for use in amplitude modulation (AM) broadcast transmission systems. In such systems, adjacent channel interference causes two annoying types of sounds:

(1) Carrier beats, which in the United States, cause 10 kHz whistles.

(2) Splatter from overlapping sidebands.

As the receiver bandwidth and fidelity is increased, these annoying sounds become more noticeable.

Carrier beats can be reduced to a point where they are not annoying by installing notch filters which attenuate the whistles 20 db or more. Since these whistles have a narrow bandwidth, the notch may be quite narrow and, therefore, such filters do not noticeably degrade the fidelity of the desired audio signals.

On the other hand splatter from overlapping sidebands covers a wide range of audio frequencies and the use of normal filter means would seriously degrade fidelity.

The present invention relates to AM signals that intentionally have substantially more energy on one side of the carrier than the other and that have an envelope that is a reasonably linear function of the input modulating wave. While the system is most suitable for use in the transmission of monophonic signals, it can be used, with some restrictions, to transmit stereophonic programs.

A significant amount of work has been done in the field of asymmetrical sideband AM transmission, see P. P. Eckersley, "Asymmetric Sideband Broadcasting", Proc. IRE, vol. 16, pp 1041–1092, September 1938; and, L. R. Kahn, "Compatible Single-Sideband", Proc. IRE, vol. 49, pp 1503–1527, October 1961 (see other references in this paper.)

As pointed out in this 1961 publication, CSSB (Compatible Single-Sideband) waves provide the following advantages:

(1) A signal-to-noise power gain for a given audio fidelity. This may be seen by recognizing the fact that the bandwidth of a receiver for CSSB need only be ½ of that for AM. Therefore, white noise should be reduced by 3 db and impulse noise by some 6 db. In practice, it appears that due to economics and the requirements for reduction of adjacent channel interference, the common broadcast receiver is actually more suitable for CSSB than for double-sideband AM reception.

(2) Improved audio fidelity. Because, as mentioned above, the receivers are too narrow for AM, halving the bandwidth of the signal allows the higher frequency components to be passed, resulting in improved fidelity.

(3) Reduction in co- and adjacent-channel interference; (a) to the CSSB listener, and (b) to the station which previously experienced interference from the station now using CSSB.

(4) Provision of a means for reducing interference caused by improperly-shielded TV receivers and other devices, because, under many practical conditions, the station may choose the appropriate sideband to reduce the interference.

The present invention requires the use of both sidebands and, therefore, does not provide the spectrum saving advantage of CSSB but does offer many of the other advantages of CSSB operation.

Most AM radio receivers are relatively narrowband devices and typically 1984 car radios have audio bandwidths in the order of 2.2 kHz at the −6 db point.

In order to provide some semblence of musical fidelity for listeners to such low fidelity receivers, broadcasters have been forced to pre-emphasize the higher frequency audio components in some cases, by as much as 20 db relative to low frequency components. Accordingly, any transmission system that is designed for AM broadcast service must be able to accommodate pre-emphasis. However, the use of large amounts of pre-emphasis makes manual tuning of receivers much more difficult because even small errors in tuning can cause unpleasant, harsh sounds.

The harsh sounds that one typically hears when a receiver is detuned severely restricts the amount of detuning used. Since optimum CSSB operation requires listeners to detune their radios, this is an important problem.

It is, therefore, an object of the present invention to provide a transmission system that allows listeners to substantially detune their receivers and still hear a pleasant sound.

It is a further object of the invention to produce a modulated wave that has sufficient pre-emphasis of high frequency components so that, when the signal is received with a narrowband receiver, reasonable quality is achieved.

SUMMARY OF THE INVENTION

In accordance with one embodiment of the present invention, a conventional AM Stereo generator, of the type described, for example, in U.S. Pat. Nos. 3,908,090 or 4,373,115, is fed by a monophonic source wherein the audio wave is controlled so as to supply unequal inputs for the L, left, and R, right, channels.

In the preferred embodiment of the invention an amplitude modulated wave is provided compatible with conventional AM receivers, incorporating envelope demodulators, said wave comprising:

(a) A carrier wave, (b) an upper sideband wave, (c) a lower sideband wave.

Said (b) and (c) sideband waves having substantial unequal average levels so that the stronger sideband produces most of the envelope modulation and the weaker sideband produces sufficient additional modulation so as to produce at least 90% and not more than 100% negative going modulation.

For example, if most of the interference was being caused by a station operating at a higher carrier frequency than the desired signal the R input can be attenuated by a factor of three times relative to the L input providing, say, 75% of the toal envelope from essentially the lower sideband and approximately 25% from the upper sideband. In the United States, existing regulations require that the stereo exciters be capable of meeting out-of-band specifications when L only or R only signals cause up to 75% envelope modulation. Therefore, in the examples described herein the stronger sideband is limited to 75% envelope modulation although higher or lower amounts may be more suitable in other nations.

A wave that has L=75% and R=25% modulation from a monophonic source has a lower amplitude L-R component than an L only 75% modulated wave and therefore causes lower out-of-band radiation than the worst case FCC test situation. Of course, if the interference was caused by a station operating at a carrier frequency below the desired signal, the L input level would have been attenuated relative to the R input.

It is noteworthy that by "off-tuning" (that is, tuning to a point on one side or the other of the carrier) the response to high frequency signal components is increased relative to the response to low frequency components. Therefore, the amount of pre-emphasis which should be used, for an off-tuned receiver, is significantly less than for center tuned receivers. This difference would be desirable even if no pre-emphasis was used for center tuned receivers. In this case, an embodiment of this invention would use de-emphasis of the higher audio frequency components of the stronger sideband and pre-emphasis for the weaker sideband. Thus, a relatively flat response would be provided for center tuned receivers and the de-emphasis will allow listeners to hear a good sound when off tuned so as to increase the signal-to-interference ratio.

For situations requiring pre-emphasis, most emphasis would be performed on the weaker sideband. The reason this is desirable is that the fact that little or no pre-emphasis was imparted to the stronger sideband significantly reduces the harshness of the sound perceived when a listener detunes a radio receiver towards the stronger sideband.

In a preferred embodiment of this invention, adjustable independent equalization circuits are provided so that stations can shape the sound to suit their individual requirements.

When the transmission system incorporates an independent sideband stereo transmitter that limits separation to say 6 kHz, a special embodiment of the invention must be utilized. In this case the upper and lower sidebands above approximately 6 kHz have, for all practical purposes, identical sideband structures. To provide the full pre-emphasis effect the relative amplitude of the low frequency components of the weaker sideband can be reduced making the overall frequency response follow a desired characteristic.

It should be stressed that a basic characteristic of the instant invention is to radiate asymmetrical sidebands that will tend to cause listeners to tune away from interference. This is readily distinguished from U.S. Pat. No. 4,194,154 wherein asymmetrical sidebands were produced in order to neutralize asymmetry in the transmitting antenna resulting in the radiation of a symmetrical sideband wave.

It is also possible to use small amounts of asymmetry when transmitting stereo signals. In this case mono listeners can still tune to reduce interference and strong signal stereo listeners can, by a small shift in setting of the "balanced" control, enjoy good stereo performance.

Also, it is possible to equalize the L and R channels for AM independently so as to avoid interference to one side while maintaining "crispiness" when signal is received by narrowband receivers. For example, a station might be apprehensive about causing additional interference on its upper sideband. More equalization can be provided for the lower sideband than the upper in such a situation. However, when stereo transmission is used, it is important that the difference in equalization should not disturb sibilant sounds that may cause unnatural spreading of speech. Sibilant sounds cover a frequency range of approximately 4 to 6 kHz.

Accordingly, the unequal sideband equalization for stereo signals, should not exceed above approximately 4 kHz. It should be noted that there is no such limitation for monophonic signal transmissions.

Therefore, when center tuned with manual tuned receivers or with electronically tuned radios that are automatically centered, the desired pre-emphasis is provided. However, when the receiver is detuned to the desired sideband, even though there is an increase in audio response, the sound is not shrill. Also, adjacent stations on the stronger side will receive less splatter.

One skilled in the broadcasting art would be aware of the fact that there is significantly more problems with interference at night and that many stations switch programming from daytime music to nighttime "talk." Accordingly, such conditions may make it desirable to provide day/night switching means so that, say, symmetrical stereo operation would be used by some stations during the daytime and they can then switch to asymmetrical sideband operation at night using the present invention.

BRIEF DESCRIPTION OF THE DRAWINGS

The foregoing and other objective features and characteristics of the present invention will be apparent from the following specification, description, and accompanying drawings relating to typical embodiments thereof.

DESCRIPTION OF THE PREFERRED EMBODIMENT

Figure 1:
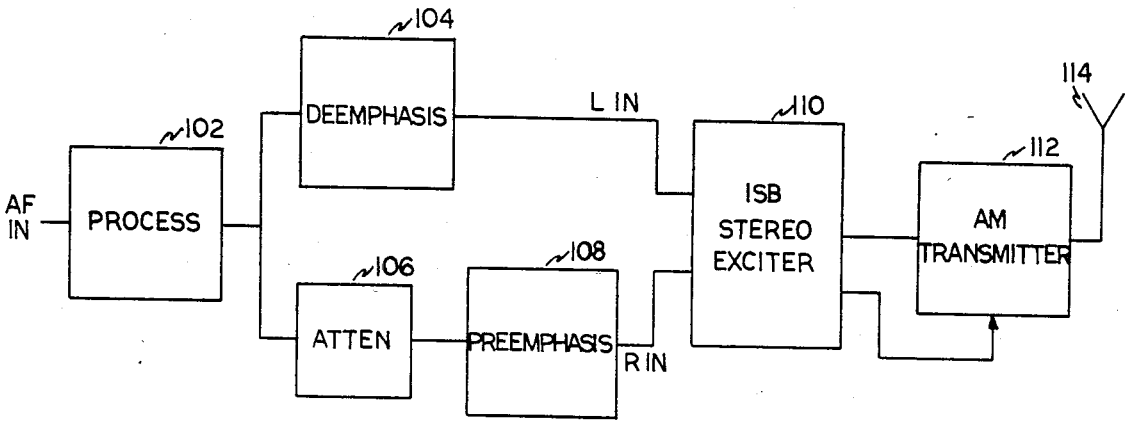
FIG. 1 is a block and schematic drawing of one embodiment of the invention incorporating a single audio processor and using an ISB Stereo exciter.

FIG. 1 is a block diagram of a transmission system embodying the invention. A source of audio feeds an audio processor which includes provisions for pre-emphasizing higher frequency audio components. Processors 102 may, for example, be a model 610 audio processor manufactured by Dorrough Electronics of Woodland Hills, Calif. The output of block 102 feeds both L and R input circuits of independent sideband (ISB) stereo exciter 10. AM Stereo exciter 110 may, for example, be model STR77 stereo exciter manufactured by Kahn Communications, Inc., of Garden City, N.Y. This stereo exciter follows the teachings of U.S. Pat. No. 3,908,090. Alternatively, block 110 may use a Kahn STR84 unit which follows the teachings of U.S. Pat. No. 4,373,115.

The path between audio processor 102 and the L input of stereo exciter 110 incorporates a de-emphasis network 104 which may be a simple RC combination so connected as to tend to compensate for the high frequency pre-emphasis provided by circuitry in block 102. It is possible to provide a de-emphasis circuit that essentially compensates for the pre-emphasis characteristic of block 102. The resulting transmission frequency response will be approximately flat for the lower sideband.

The output of processor 102 also feeds the R stereo input through attenuator 106 and pre-emphasis circuit 108. The effect of these two blocks is to reduce the modulation produced by the upper-sideband therefore allowing more room for the lower-sideband and to accentuate the pre-emphasis of the higher frequency components of the upper-sideband. The additional pre-emphasis compensates for the reduction or elimination of pre-emphasis provided by the lower-sideband components. The overall desired result is to provide the required pre-emphasis effect when a listener tunes his or her receiver so as to center on the carrier. This is accomplished in such a manner as to allow listeners to tune off center so as to better receive the lower sideband thereby reducing adjacent channel interference above the desired station's assigned frequency.

Thus, the L and R audio inputs have the correct levels and pre-emphasis characteristics to produce the desired upper and lower-sidebands. The ISB Stereo Exciter, 110, generates a phase modulated RF carrier wave and an audio wave that is then used to respectively excite and envelope modulate AM transmitter 112. The resulting output wave is essentially an asymmetrical wave with a low distortion envelope.

Figure 2:
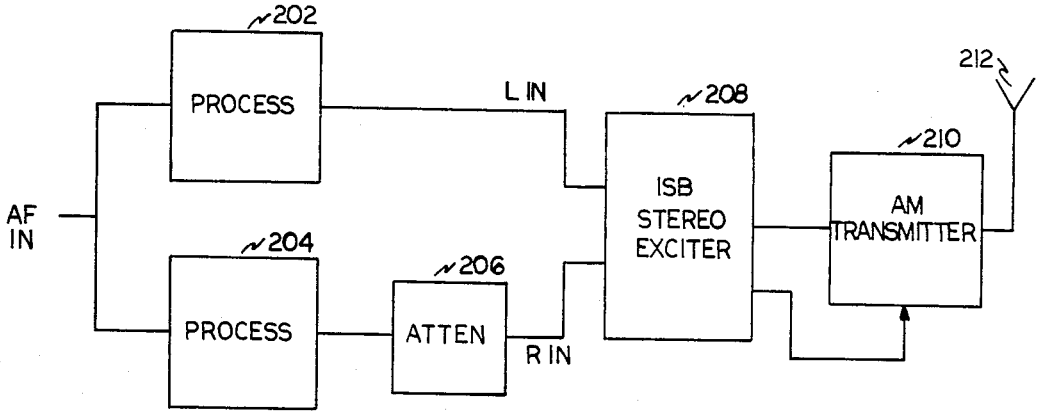
FIG. 2 is a block diagram of another embodiment of the invention using two audio processors and an ISB Stereo exciter.

FIG. 2 is a block and schematic drawing of an AM transmitting system embodying the invention. A source of program material, in this case a monophonic source, feeds both audio processors 202 and 204. Audio processor 204 feeds attenuator 206. Actually, this attenuator, as well as attenuator 106 in FIG. 1, may be part of the ISB (Independent Sideband) AM Stereo Exciter 208. Alternatively, attenuator 206 may be incorporated in processor 204.

The two outputs of exciter 208 are fed to transmitter 210, the phase modulated RF wave providing RF drive for the transmitter while the audio signal feeds the envelope modulation circuitry of the transmitter.

The output of the transmitter, which is fed to antenna 212, is a carrier plus upper and lower-sidebands. The lower-sideband carries the signal components which pass through block 202 and the upper-sideband carries the signal components which pass through blocks 204 and 206.

Figure 3:
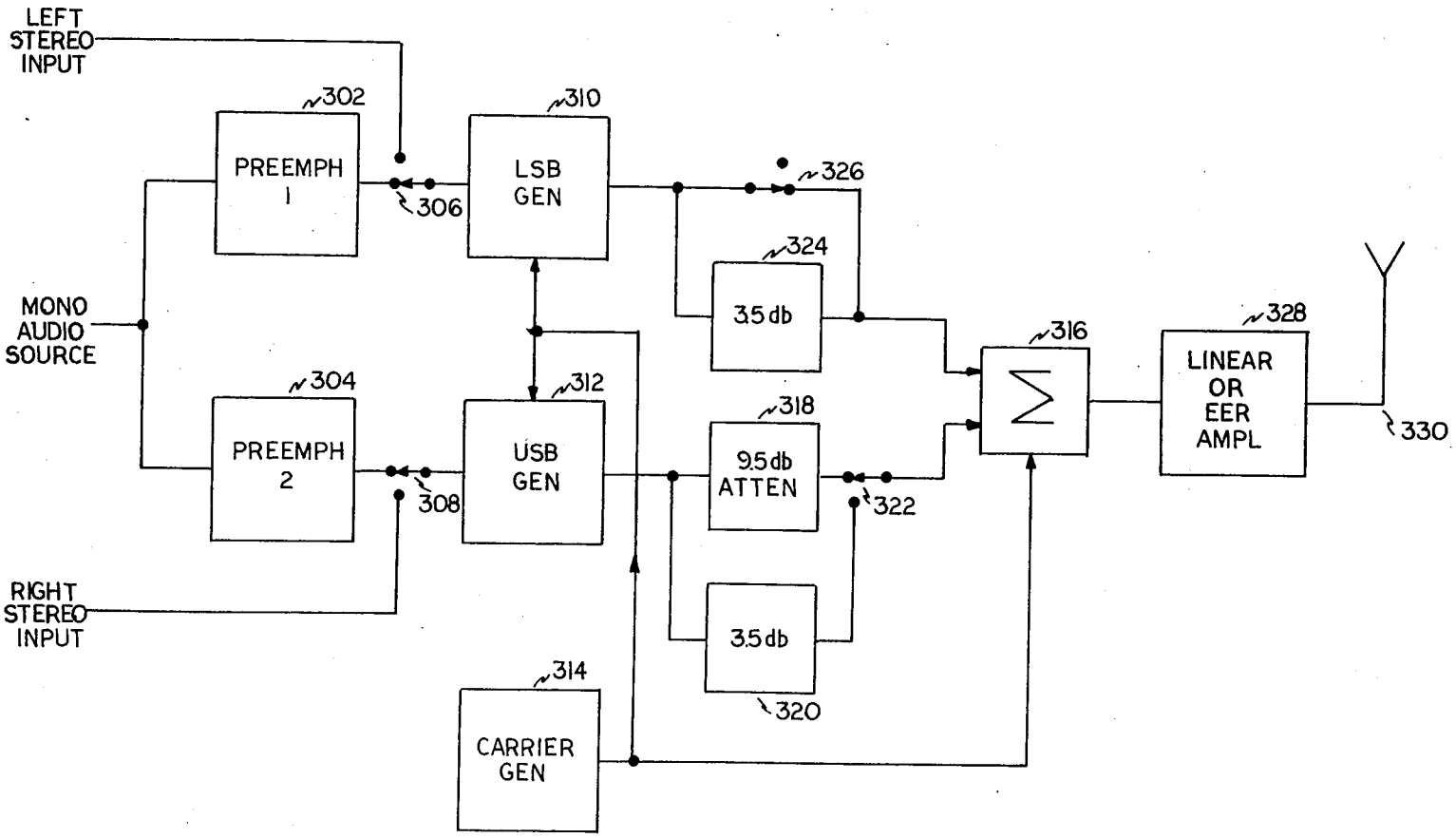
FIG. 3 is a block diagram of another embodiment of the invention using an ISB generator. Switching circuitry is included which allows the equipment to be switched between mono programming with asymmetrical sidebands to stereo operation with equal average amplitude sidebands.

FIG. 3 shows another embodiment of the invention using conventional SSB generators rather than an ISB stereo generator. Since the arrangement shown does not include means for providing a second order sideband some envelope distortion will be introduced. On the other hand, the spectrum produced will be somewhat "cleaner" than a conventional ISB stereo wave. Besides reducing interference there is less reason to utilize the mixed high concepts; i.e., make the sidebands symmetrical above some frequency, for example, above 6,000 Hz.

It should be noted that switching means is provided so that it is possible to switch in and out of the asymmetry at different times of the day; for example, when stereophonic music rather than mono talk programs are to be transmitted.

A monophonic audio source feeds both pre-emphasis circuit 1, 302 and pre-emphasis circuit 2, 304. It is assumed that audio processing circuitry is incorporated in the path of the mono audio source prior to feeding blocks 302 and 304. Additional processing may be incorporated in pre-emphasis circuits 1 and 2, if desired.

The output of block 302 feeds lower-sideband generator 310 the output of which is passed through switch 326 to summation circuit 316. The output of pre-emphasis circuit 2, 304 feeds upper-sideband generator 312. The output of block 312 feeds attenuator 318 which, for this example, provides 9.5 db of attenuation. The output of this attenuator passes through switch 322 into summation circuit 316.

Carrier generator 314 which feeds the two sideband generators 310 and 312 also feeds summation circuit 316.

The output of summation 316 is a full carrier plus two unequal sidebands wave. The lower-sideband is stronger, by a factor of 9.5 db than the upper-sideband due to inclusion of attenuator 318 in the path of the upper-sideband wave.

The output of summation circuit 316 has both envelope modulation components and angular modulation components and may either be amplified in a linear amplifier or an envelope elimination and restoration amplifier in accordance with the teachings of U.S. Pat. No. 2,666,133. The output of amplifier 328 feeds antenna 330.

If switches 306, 208, 322 and 326 are thrown to their alternative positions, the transmitting circuit will be suitable for stereo operation. In this case the gains for the upper and lower-sidebands are equal because equal attenuators, 320 and 324, are switched into the upper and lower-sideband paths.

Figure 6:
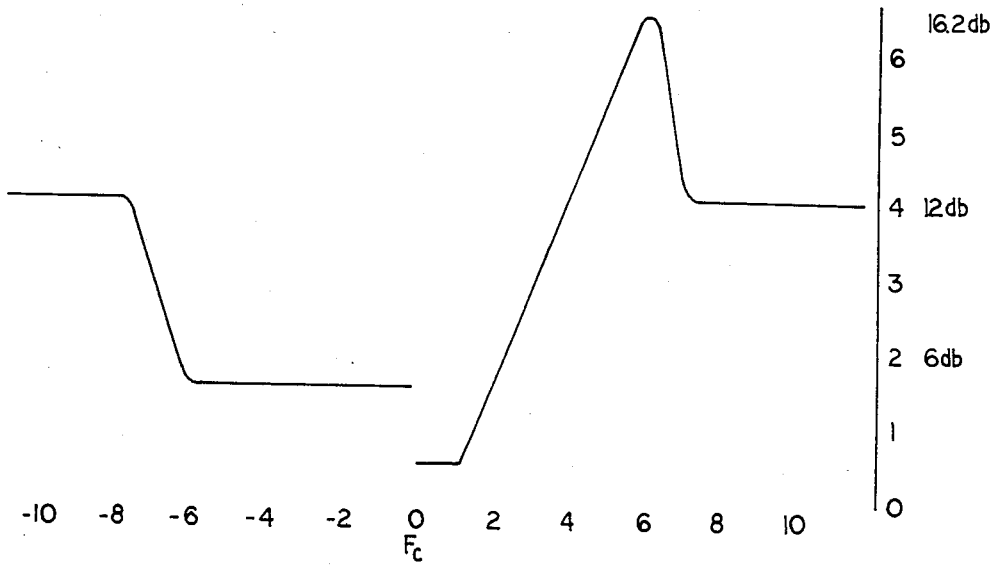
FIG. 6 shows the frequency response characteristic of an asymmetrical sideband transmission system according to one embodiment of the invention.
Figure 7:
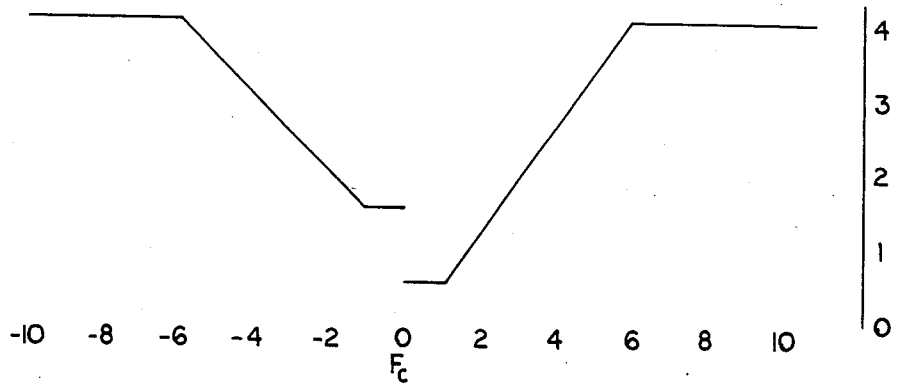
FIG. 7 shows another possible frequency response characteristic of an asymmetrical sideband transmission according to the invention.

In accordance with the present invention the apparatus illustrated by FIGS. 1, 2 and 3 produce sideband structures illustrated in FIGS. 6 and 7 wherein the lower-sideband is about 10 db (one preferred embodiment 3/1 or 9.5 db) greater in amplitude than the upper-sideband. Thus, for a maximum modulation of −100%, the lower-sideband is used to provide approximately 75% of the envelope modulation and the upper-sideband provides approximately 25% of the envelope modulation.

Figure 4:
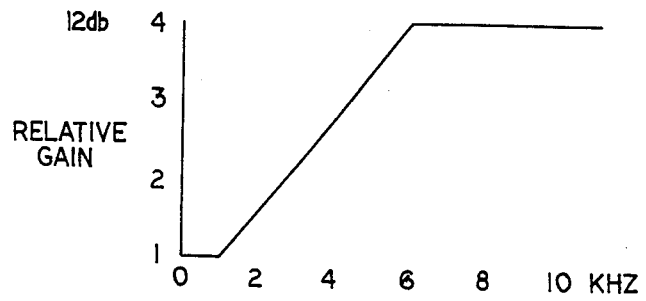
FIG. 4 shows the relationship between relative gain and frequency which is used as an example to describe the invention. This relationship is known as a pre-emphasis curve and such characteristics are used by AM broadcasters to compensate for poor fidelity of common AM receivers.

FIG. 4 is an example of an audio pre-emphasis curve showing 12 db of pre-emphasis for audio frequency components at and above 6 kHz relative to the gain for components at frequencies at and below 1 kHz. The straight line relationship is arbitrary and was selected merely to simplify the discussion. It is well known that higher frequency voice and music components are generally of weaker amplitude than those at low and mid-range frequencies. Accordingly, reasonable amounts of pre-emphasis of the higher frequency components can be provided without causing excessive modulation sideband components.

Figure 5:
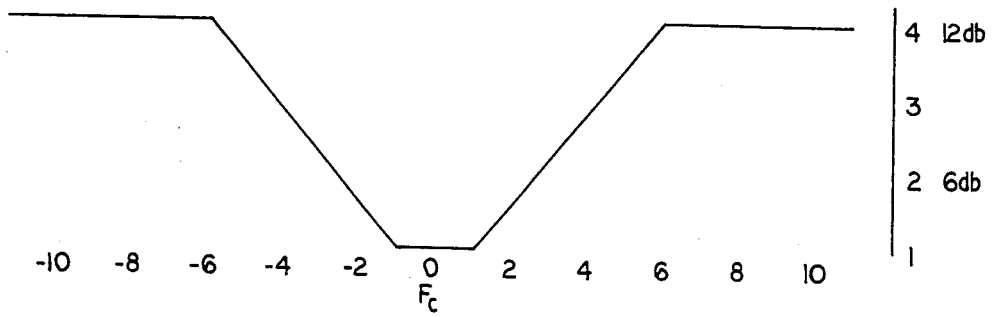
FIG. 5 shows how the pre-emphasis curve of FIG. 4 would impact on the operation of a conventional double-sideband AM transmission system.

FIG. 5 shows how the pre-emphasis illustrated in FIG. 4 would be applied to the sideband response of a conventional double-sideband AM wave. The relative gain for low frequency components is unity and for components above 6 kHz the gain is 4 times; i.e., 12 db.

Note that the response curves of the two sidebands have a mirror symmetry relationship.

FIG. 6 shows one embodiment of the instant asymmetrical sideband invention. Note that it is assumed that the ISB type AM Stereo system, commonly called Kahn/Hazeltine stereo is used and that there is no stereo separation above 7.5 kHz providing "mixed highs" operation. Note also that the relative gain for the lower-sideband low frequency components; i.e., 1 kHz and below, are assumed, for this example (as well as the one illustrated in FIG. 7) to have three times the gain of the low frequency components of the upper-sideband. In other words, the low frequency components of the lower-sideband will produce almost 10 db more modulation for the low frequency components of the upper-sideband.

In order to provide the clue to listeners that they should tune to the side away from the interference, it is important that the perceived loudness should be greater on the side away from the interference. Thus, the effect of the larger amount of pre-emphasis of the weaker sideband should not overcome the increased low frequency gain for the favored sideband. As a compensating effect, a listener will naturally favor tuning away from the harsher sound he hears when tuning to the heavily pre-emphasized sideband.

0ne approach is to make the stronger sideband flat; i.e., no pre-emphasis and the weaker sideband support all of the pre-emphasis. In this case the sensitivity to detuning the receiver to the stronger sideband is small. However, the pre-emphasis of the weaker sideband will, at times, have some additional energy over and above the normal energy level. Compare FIGS. 5 and 6.

This situation can be alleviated by putting some pre-emphasis in the larger amplitude sideband path. FIG. 7 illustrates the case where the pre-emphasis provided is such that at the frequency where the pre-emphasis reaches the maximum point the two sidebands are equal in amplitude.

In FIG. 7, the same low frequency siituation (i.e., the lower-sideband is almost 10 db stronger than the upper-sideband) is shown as in FIG. 6. However, unlike the embodiment of FIG. 6 part of the pre-emphasis is provided by the stronger sideband which, in this example, is the lower-sideband. Nevertheless, since most of the pre-emphasis is achieved in the upper-sideband a reasonable amount of receiver detuning is allowable. Actually, for this example, the upper-sideband offers almost 10 db more pre-emphasis than the lower-sideband; i.e., 8.5 db to 18.1 db. The perceived loudness, when tuning to the lower-sideband, should be greater than tuning to the upper-sideband. This provides the listener with an important clue causing him to favor tuning his receiver away from the interference.

Furthermore, the harsher sound of the upper-sideband due to the use of greater pre-emphasis, should naturally cause listeners to eschew tuning towards the upper-sideband (assumed for these examples) towards the interference.

It should be stressed that the amount and character of the pre-emphasis to be used in practicing the invention is a function of many factors, including the selectivity characteristics of the receivers used, the type of music to be transmitted, the character and strength of the interference, etc. Therefore, it is to be expected that a wide variety of pre-emphasis curves would be used by stations implementing the instant invention.

In all cases, it is understood that the above described arrangements are merely illustrative of the many possible specific embodiments which represent applications of the present invention. Numerous and other varied arrangements can be readily devised in accordance with the principles of the present invention without departing from the spirity and scope of the invention.

What is claimed is:

1. An amplitude modulated radio transmission system, compatible with conventional AM receivers both center tuned to the carrier and off center tuned favoring one sideband and capable of providing pre-emphasis of the higher frequency audio frequency components relative to the lower frequency components to improve the overall fidelity of reception when narrowband receivers are used, comprising:

(a) an amplitude modulated transmitter capable of generating substantially independent upper and lower sidebands with a carrier component and having separate audio modulating circuits;

(b) means for feeding an audio signal to both audio circuits;

(c) separate means for shaping the frequency response of the upper and lower sidebands the frequency shaping means for one sideband substantially flat and means for shaping the other sideband in such a manner as to accentuate the higher frequency components, the summation of sideband frequency shaping optimized for reception with narrowband receivers, (d) means for attenuating the modulation level of one sideband relative to that of the other sideband which the higher level fed to the substantially flat separate (c) means and the weaker modulating level fed to the (c) means having the higher frequency accentuation, the combined modulating levels sufficient to provide relatively full modulation.

2. An AM Transmission system suitable for reception by receivers equipped with envelope demodulation, comprising:

(a) means for generating independent upper and lower sidebands with separate inputs for each sideband generation means;

(b) means for feeding essentially the same information to each sideband input generating neans;

(c) means for unbalancing the level of the sidebands so that one sideband is substantially different in amplitude than the other sideband, and;

(d) means for causing the ratio of the amplitude of the frequency components further from the carrier to the frequency components closest to the carrier of the weaker sideband to be greater than the ratio of the furthest to the closest components of the stronger sideband.

3. The means of claim 2 with additional means for switching to symmetrical stereo operation at certain time periods and switching to asymmetrical sideband operation at other times.

4. The method of producing an amplitude double sideband wave which is compatible with both center tuned to the carrier AM receivers and off center tuned receivers comprising:

(a) deriving from a monophonic source of voice and/or music audio waves two audio waves;

(b) attenuating one of the two audio waves by approximately 10 db;

(c) feeding the attenuated audio wave to one sideband input of an independent sideband full carrier transmitter, and;

(d) feeding the unattenuated audio wave to the second sideband input of the independent sideband full carrier wave.

5. The method of producing an amplitude modulated double sideband wave which is compatible with both center tuned to the carrier AM receivers and off center tuned receivers, comprising:

(a) deriving from a monophonic source of voice and/or music audio waves two audio waves;

(b) attenuating one of the two audio waves by approximately 10 db;

(c) feeding the attenuated audio wave to one of the audio inputs of an independent sideband type AM stereo transmitter; and, (d) feeding the unattenuated audio wave to the second audio input of said AM stereo transmitter.

6. The method of claim 5 including the additional step of pre-emphasizing the higher frequency components of at least the attenuated audio wave so as to provide a different degree of pre-emphasis for components on one side of the carrier than the other.

* * * * *